United States Patent [19]

Yount

[11] 3,949,916

[45] Apr. 13, 1976

[54] TOBACCO POUCH AND ACCESSORY CARRIER

[76] Inventor: Robert E. Yount, 11108 W. 70th Terrace, Shawnee, Kans. 66203

[22] Filed: Nov. 29, 1974

[21] Appl. No.: 528,282

[52] U.S. Cl. ..... 224/26 R; 206/260

[51] Int. Cl.[2] ..... A45C 11/00

[58] Field of Search .... 224/26 R, 26 B, 26 D, 26 G, 224/26 K, 5 R, 5 A, 5 B, 5 C, 5 H, 5 Q, 5 V, 2 B, 2 D, 2 E, 2 F; 206/260, 242, 38, 86; 229/56

[56] References Cited

UNITED STATES PATENTS

| | | | |
|---|---|---|---|
| 763,519 | 6/1904 | Taylor et al. | 224/26 K |
| 1,506,926 | 9/1924 | Gunter | 206/260 X |
| 3,294,298 | 12/1966 | Danielson | 224/5 A |
| 3,797,717 | 3/1974 | Collins | 224/26 R X |
| 3,850,352 | 11/1974 | Reiner | 224/26 B |
| 3,854,639 | 12/1974 | Genchi | 224/26 B |

*Primary Examiner*—Robert J. Spar
*Assistant Examiner*—Jerold M. Forsberg
*Attorney, Agent, or Firm*—Fishburn, Gold & Litman

[57] ABSTRACT

A combination of a tobacco pouch carrier and a container therefor wherein the carrier is adapted to be supported on the belt of a person and includes front and rear members having side edges and spaced portions of certain end edges thereof secured together to define the carrier and having a passage between the spaced portions of said end edges and an entrance between other end edges of the front and rear members. The rear member has an extension defining a flap adapted to be in covering relation with and releasably fastened to an exterior surface of the front member. An elongated strap is secured to the rear member and is adapted to be releasably fastened to an intermediate portion of the strap to define a loop around an elongated member, such as a belt of a person. The carrier includes a second front member having portions thereof secured to the outwardly facing surface of the first front member to define a compartment having an entrance between the second front member and the first front member.

3 Claims, 6 Drawing Figures

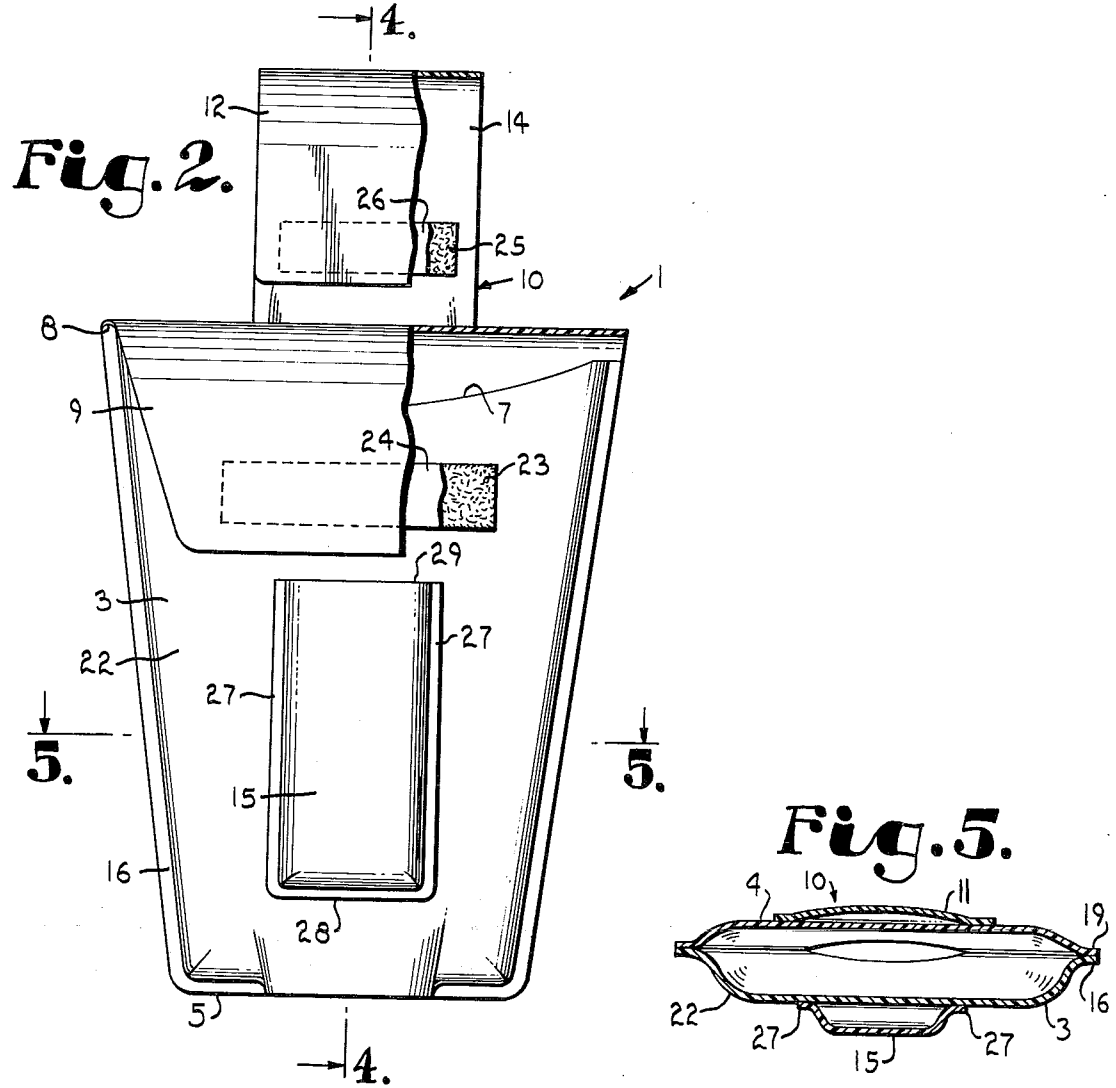
Fig. 2.
Fig. 5.
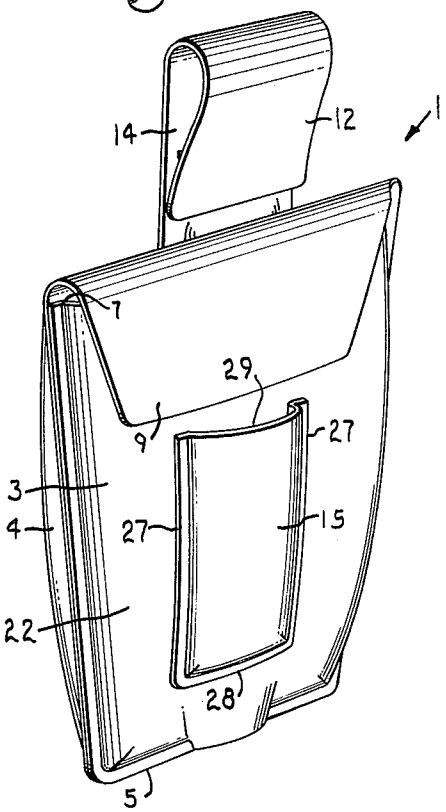
Fig. 1.

TOBACCO POUCH AND ACCESSORY CARRIER

The present invention relates to tobacco pouches and more particularly to a container and a carrier therefor which is adapted to be supported on an elongated member, such as a belt of a person.

The principal objects of the present invention are: to provide a container and carrier therefor adapted to be supported on an elongated member, such as a belt of a person; to provide such a container for tobacco which maintains the tobacco in a fresh condition for use; to provide such a container and carrier therefor wherein the container is disposable; to provide such a carrier having a compartment on a front portion thereof adapted to removably contain a plurality of accessories, such as pipe cleaners; to provide such a container and carrier therefor having releasable fastening material on respective facing portions of a strap for mounting the carrier on an elongated member, such as a belt of a person and removing same therefrom and on a flap of the carrier for selectively opening and closing the carrier; to provide such a container and carrier therefor having corresponding shapes; and to provide such a container and carrier therefor which is economical to manufacture, durable in construction, attractive in appearance, and particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and include an exemplary embodiment of the present invention and illustrate various objects and features of the container and carrier therefor.

FIG. 1 is a perspective view of a tobacco pouch carrier embodying features of the present invention.

FIG. 2 is a front elevational view of the carrier with portions thereof broken away to better illustrate the component parts.

FIG. 5 is a transverse sectional view taken on line 5—5, FIG. 2.

Figure 6:
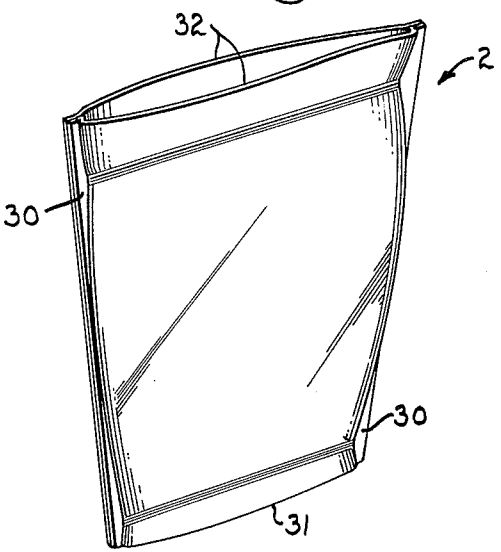
FIG. 6 is a perspective view of a container or liner removably received in the tobacco pouch carrier.
Figure 4:
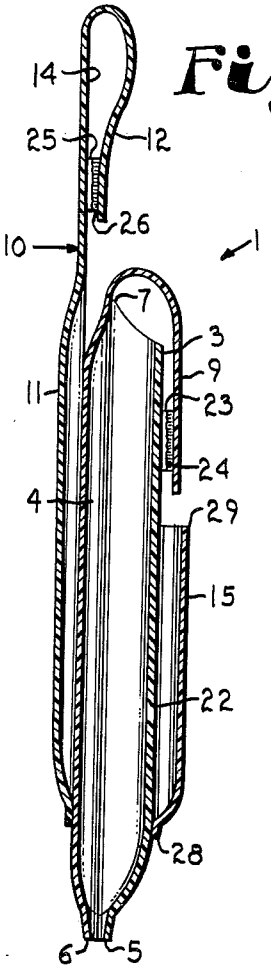
FIG. 4 is a longitudinal sectional view taken on line 4—4, FIG. 2.
Figure 3:
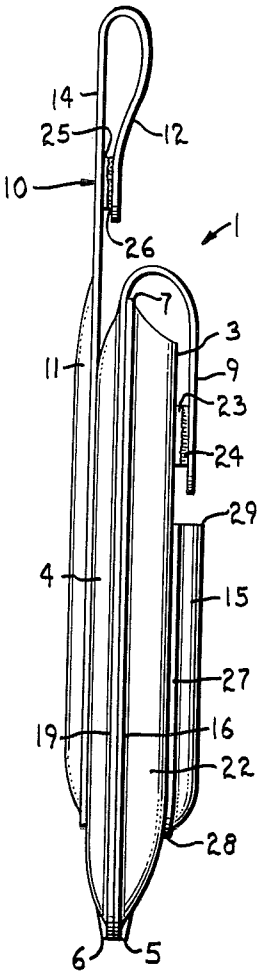
FIG. 3 is a side elevational view of the carrier with portions broken away to better illustrate the component parts.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

In the disclosed embodiment of the present invention, the reference numeral 1 designates generally a tobacco pouch carrier adapted to be supported on an elongated member, such as a belt of a person. The carrier 1 removably receives a container 2 and includes front and rear members 3 and 4 respectively each having side edges thereof and spaced portions of first end edges thereof secured together to define the carrier 1 which has a passage between the first end edges 5 and 6 and an entrance between second end edges 7 and 8 of the front and rear members 3 and 4 respectively. The rear member 4 has an extension 9 defining a flap adapted to be in covering relation with and releasably fastened to an exterior surface of the front member 3. An elongated strap 10 has one end portion 11 thereof secured to the rear member 4 and the other end portion 12 thereof is adapted to be positioned in facing relation with and releasably fastened to an intermediate portion 14 of the strap 10 to define a loop around an elongated member, such as a belt of a person. The carrier 1 includes a second front member 15 having opposite edges thereof and one end edge thereof secured to the outwardly facing surface of the front member 3 to define a compartment having an entrance between the other end edge 8 of the second front member 15 and the exterior surface of the first front member 3.

The front and rear members 3 and 4 respectively forming the carrier or pouch 1 may be formed of any suitable flexible material which is flexible or expandable to conform to the shape of the container 2 and the contents therein. Non-woven material or vinyl, soft finished leather, polyurethane fabric with a backing of cotton stretch knit fabric, and the like have been found to possess the desired characteristics.

The front member 3 has opposite side edges 16 extending between the lower edge 5 and the upper edge 7 thereof. The rear member 4 has opposite side edges 19 extending between the lower edge 6 and the upper edge 8 thereof.

Each of the opposite side edges 19 of the rear member 4 are suitably secured to respective opposite side edges 16 of the front member 3 and spaced end portions of the lower edges 5 and 6 of the front and rear members 3 and 4 respectively are suitably secured together to define a passage between the lower ends 5 and 6 of the front and rear members 3 and 4 respectively whereby tobacco particles, dust, and the like may pass therebetween.

The side edges and spaced end portions of the lower edges of the front and rear members 3 and 4 respectively may be joined together in any suitable manner, such as heat sealing, sonic bonding, stitching, and the like.

The extension 9 of the rear member 4 defines a flap adapted to be in covering relation with an exterior surface 22 of the front member 3. Releasable fastening means are mounted on facing surfaces of the extension 9 and on the exterior surface 22 of the front member 3 for selectively opening and closing the entrance to the pouch or carrier 1.

In the illustrated structure, cooperating portions are adapted to retain the extension 9 positioned in facing relation with the exterior surface 22 of the front member 3. A first textile covering 23 has a backing portion thereof secured to the exterior surface 22 of the front member 3 and an exposed surface of pile fabric having upstanding loops. A second textile covering 24 has a backing portion thereof mounted on the extension 9 and having integral outwardly extending stiff hooks and spines formed of broken loops of filament and is thereby adapted for retentive imbedment in the upstanding loops of the first textile covering 23 upon contact or engagement therewith. A suitable material for the textile coverings 23 and 24 is "VELCRO" fastener material or the like.

The elongated strap 10 has the one end portion 11 thereof secured to the rear member 4 and the strap 10 extends beyond the upper end or edge portion of the front and rear members 3 and 4 respectively. The strap 10 has an other end portion 12 thereof adapted to be positioned in facing relation with the intermediate portion 14 of the strap 10 to define a loop. The strap 10 may be formed of any suitable durable material, such as leather, plastic, and the like.

The strap 10 and the rear member 4 cooperate to define a pocket therebetween which has an entrance adjacent the upper edge 8 of the rear member 4. In the illustrated embodiment, the one end portion 11 of the strap 10 has an end and opposite side edges thereof secured to the rear member 4 whereby the center of the end portion 11 of the strap 10 is spaced from the rear member 4 to define the pocket which is adapted to receive accessories, such as pipe cleaners or the like.

Releasable fastening means are mounted on the facing portions of the strap 10 for selectively retaining same in the loop defining position to receive an elongated support member therein, such as the belt of a person. The fastening means are preferably of the same material as the fastening means for the extension 9 and the exterior surface 22 of the front member 3.

In the illustrated structure, a first textile covering 25 has a backing portion mounted or secured on the intermediate portion 14 of the strap 10 and has an exposed surface of pile fabric having upstanding loops. A second textile covering 26 has a backing portion suitably secured on the other end portion 12 of the strap 10 and has integral outwardly extending stiff hooks and spines formed of broken loops of filament and is thereby adapted for retentive imbedment in the surface of the first textile covering 25 upon contact or engagement therewith. Suitable material for the textile coverings 25 and 26 is "VELCRO" fastener material or the like.

The second front member 15 has opposite side edges 27 and a lower edge 28 thereof suitably secured to the exterior surface 22 of the front member 3. An upper edge 29 of the second front member 15 is spaced from the exterior surface 22 of the front member 3 to define an entrance to a compartment adapted to receive accessories, such as filters, a plurality of elongated pipe cleaners, or the like.

The container 2 provides a stay fresh container or liner for tobacco and is removably received in the carrier or pouch 1 and has an entrance and means for selectively closing and opening same. The illustrated container 2 has facing panels formed of a suitable non-woven material, such as polyvinyl chloride or the like, and is thereby adapted to retain tobacco in a fresh condition for use. The illustrated liner or container 2 has opposite side edges 30 of the facing panels and lower edges 31 thereof suitably joined or secured together, as by heat sealing or the like. Suitable interengaging portions are mounted on the facing panels adjacent the upper edges 32 thereof and may be formed of a member having a recess or groove on one panel and a rib or projection on the other panel and having a shape adapted to be removably received in the groove. The container 2 preferably has an exterior shape corresponding to the shape of the carrier. It may be desirable to provide a second entrance to the container 2 whereby material, such as tobacco, may be removed from either end of the liner or container 2, therefore, suitable interengaging portions are mounted on the facing panels adjacent the lower edges 31 of the liner 2 and are substantially similar to the interengaging portions adjacent the upper edges 32. When the liner 2 has the second entrance, the lower edges 31 of the facing panels are not secured together.

The liner or container 2 is economical to manufacture and may be a disposable item and may be sold filled with tobacco and may be discarded when empty.

In using a container and carrier therefor, as illustrated and described, the container 2 is opened and filled with fresh tobacco. The upper and lower edges of the liner 2 are then closed to retain the fresh condition of the tobacco. The flap or extension 9 is then opened and the container 2 is placed in the carrier 1. The flap 9 is then closed. The other end portion 12 is separated from the intermediate portion 14 and the strap 10 is placed around the belt of a person and the portions 12 and 14 are positioned in engagement to retain the carrier on the belt. When it is desired to have access to the container 2, the flap or extension 9 is separated from the exterior surface 22 of the front member 3. The container 2 is then removed from the carrier 1 and opened to permit dispensing of a selected quantity of tobacco therefrom. The container 2 is then reclosed and placed in the carrier 1 with the flap or extension 9 being secured to the exterior surface 22 of the front member 3. The liner 2 may remain in the carrier 1 during removal of a portion of the tobacco, as by inserting a smoker's pipe between the upper edges 32 of the facing panels of the liner 2. The tobacco may be poured from the lower end of the container 2 after same is removed from the carrier 1.

It is to be understood that while I have illustrated and described one form of my invention, it is not to be limited to the specific form or arrangement of parts herein described and shown.

What I desire to secure and claim by Letters Patent is:

1. A tobacco pouch carrier combination comprising:

a. a rear member having opposite side edges and first and second end edges;

b. a front member overlying said rear member and having opposite side edges and first and second end edges in substantially registering relation with respective opposite side edges and first and second end edges of said rear member, said opposite side edges of said front member each being secured to a respective one of the opposite side edges of said rear member, one of said first and second end edges of said front member having spaced portions thereof secured to respective spaced portions of a respective one of said first and second end edges of said rear member to define a passage between said respective end edges of said front and rear members and an entrance between the other end edges of said front and rear members;

c. an elongated extension on said rear member defining a flap adapted to be in covering relation with a portion of said front member;

d. cooperating fastening means on facing surfaces of said extension of said rear member and on said front member for releasably closing the entrance between the other end edges of said front and rear members;

e. an elongated strap having one end portion thereof secured to said rear member and extending beyond the other end edges of said front and rear members, said strap having an other end portion thereof adapted to be positioned in facing relation with an intermediate portion of said strap to define a loop, said one end portion of said strap being secured to said rear member in a manner to define an open top pocket;

f. second cooperating fastening means on the facing portions of said strap for releasably retaining same in the loop defining position to receive a support member therein;

g. a second front member having opposite side edges and first and second end edges, said opposite side edges of said front member each being secured to an outwardly facing surface of said first named front member, one of said first and second end edges of said second front member being secured to the outwardly facing surface of said first named front member to define a compartment having an entrance between the other end edge of said second front member and the outwardly facing surface of said first named front member; and h. a flexible container removably received between said rear member and said front member and having at least one entrance and entrance closing means for selectively securing same in a closed position.

2. A tobacco pouch carrier combination as set forth in claim 1 wherein:

a. said flexible container includes facing panels each having opposite side edge portions and opposite end edge portions;

b. certain of said side edge portions and said end edge portions are secured together to define said container having at least one entrance; and c. said entrance closing means for securing said at least one entrance in a closed position includes interengaging portions mounted on said facing panels and adapted to permit selectively opening and closing said at least one entrance.

3. A tobacco pouch carrier combination as set forth in claim 1 wherein:

a. said flexible container includes facing panels each having opposite side edge portions and opposite end edge portions;

b. said side edge portions are secured together whereby said container has a first entrance and a second entrance each positioned between respective opposite end edges of said facing panels; and c. said entrance closing means for said first entrance and for said second entrance each includes interengaging portions mounted on said facing panels adjacent said respective opposite end edge portions and adapted to permit selectively opening and closing said first entrance and said second entrance.

* * * * *